US007389566B2

(12) United States Patent
Leinders

(10) Patent No.: US 7,389,566 B2
(45) Date of Patent: Jun. 24, 2008

(54) APPARATUS AT A SPINNING PREPARATION MACHINE FOR CHANGING SILVER CANS

(75) Inventor: Christoph Leinders, Korschenbroich (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 229 days.

(21) Appl. No.: 11/300,371

(22) Filed: Dec. 15, 2005

(65) Prior Publication Data

US 2006/0130281 A1 Jun. 22, 2006

(30) Foreign Application Priority Data

Dec. 22, 2004 (DE) ..... 10 2004 063 026

(51) Int. Cl.
*D01G 27/00* (2006.01)

(52) U.S. Cl. ..... 19/159 A

(58) Field of Classification Search ..... 19/159 A, 19/159 R

See application file for complete search history.

(56) References Cited

U.S. PATENT DOCUMENTS

| | | | | |
|---|---|---|---|---|
| 5,446,946 | A * | 9/1995 | Leifeld | 19/159 A |
| 5,475,899 | A | 12/1995 | Sramek | |
| 5,634,316 | A * | 6/1997 | Leifeld | 53/116 |
| 5,664,398 | A * | 9/1997 | Leifeld | 53/118 |
| 5,687,454 | A * | 11/1997 | Langen | 19/159 A |
| 5,774,941 | A * | 7/1998 | Huang et al. | 19/159 R |
| 6,578,238 | B2 * | 6/2003 | Bettinger | 19/159 R |
| 2002/0152586 | A1 * | 10/2002 | Bettinger | 19/159 R |
| 2006/0130282 | A1 * | 6/2006 | Leinders | 19/157 |

FOREIGN PATENT DOCUMENTS

| | | | |
|---|---|---|---|
| DE | 42 31 698 | A1 | 9/1992 |
| DE | 44 07 110 | A1 | 3/1994 |
| DE | 44 11 547 | A1 | 4/1994 |
| DE | 295 20 834 | U1 | 3/1995 |
| DE | 102 08 806 | A1 | 3/2002 |
| GB | 942278 | | 11/1963 |
| GB | 1 523 490 | | 8/1978 |
| GB | 2 277 937 | A | 11/1994 |

OTHER PUBLICATIONS

United Kingdom Search Report mailed Apr. 18, 2006, which issued in Application No. GB0525693.8.

* cited by examiner

*Primary Examiner*—Shaun R Hurley
(74) *Attorney, Agent, or Firm*—Venable LLP; Robert Kinberg; Steven J. Schwarz

(57) ABSTRACT

In an apparatus at a spinning preparation machine for changing sliver cans, a sliver is delivered by a rotary plate 25 and deposited in a sliver can 15. Means are provided for moving a full sliver can 15, away from the region of the rotary plate for subsequently bringing in an empty sliver can $\mathbf{15}_2$ from a position of readiness to the region of the rotary plate. A first can path $\mathbf{27}_1$ is provided in the region of the rotary plate and a second can path $\mathbf{27}_2$ is provided parallel to the first can path, on each of which can paths a can carrier (26; 30) is movable in two directions. In order to provide an advantageous apparatus for sliver can changing, a can carrier 30 on the second can path $\mathbf{27}_2$ is capable of delivering an empty can to, and collecting a full can from, the first can path 27.

19 Claims, 2 Drawing Sheets

APPARATUS AT A SPINNING PREPARATION MACHINE FOR CHANGING SILVER CANS

CROSS REFERENCE TO RELATED APPLICATION

This application claims priority from German Patent Application No. 10 2004 063 026.7 dated Dec. 22, 2004, the entire disclosure of which is incorporated herein by reference.

SUMMARY OF THE INVENTION

The invention relates to an apparatus at a spinning preparation machine, for example a card, card drawing mechanism, draw frame, combing machine or the like, for changing sliver cans. In one known arrangement a sliver is delivered by a rotary plate and deposited in a sliver can, the arrangement comprising means for moving a full sliver can away from the region of the rotary plate and comprising means for subsequently bringing in an empty sliver can from a position of readiness to the region of the rotary plate, wherein a first can path is provided in the region of the rotary plate (coiler plate) and a second can path is provided parallel to the first can path, on which can paths can carriers are movable in two directions, and wherein an empty can is arranged to be moved from a second can path to a first can path and a full can is arranged to be moved from the first can path to a second can path.

DE 44 07 110 A discloses an apparatus of such a kind.

It is an aim of the invention to improve the apparatus for sliver can change still further.

The invention provides a can-changing apparatus for a spinning preparation machine, comprising:

- a first can path including a filling position in which a can can receive sliver from a rotary delivery device;
- a first can carrier movable along said first can path;
- a second can path; and
- a second can carrier movable along said second can path wherein the second carrier on the second can path is arranged to deliver an empty can to the first can carrier and to collect a full can from the first can carrier.

As a result of the fact that two can paths and two can carriers are provided; a considerable simplification is brought about in terms of construction. Moreover, as a result of arranging a full can and an empty can on one can carrier, especially fast can changing from the full can to the empty can is achieved because only one can carrier, common to both, needs to be moved. A further advantage is that the second can carrier on the parallel path collects either a full can or an empty can, that is to say by using only one can carrier both a collection function and a delivery function are accomplished by means that are simple in terms of construction. Finally, the second can carrier fulfils yet another double function because it both conveys empty cans out of the can magazine and also conveys full cans into the can magazine.

Advantageously, an empty can is arranged to be moved from the second can carrier onto the first can carrier and a full can is arranged to be moved from the first can carrier onto the second can carrier. Preferably, the sliver can is a oblong can. Advantageously, the movement of the oblong can during sliver deposition is a rectilinear movement to and fro. Advantageously, the full can is moved away from and/or the empty can is subsequently brought in to the region of the sliver delivery device in the longitudinal direction of the can (via a short wall surface). Advantageously, the empty can is arranged to be moved from the second can carrier to the first can carrier and from the first can carrier to the second can carrier in the transverse direction of the can (via the long wall surfaces). Advantageously, during transfer of the full can and/or empty can between the can carriers, the can carriers are arranged to be moved at the same speed in the same direction. Preferably, the first can path and the second can path are arranged parallel to one another. Advantageously, the length of the first can path and the length of the second can path both correspond to at least four times one can length. Advantageously, at least one displacement device is provided, by means of which the cans are arranged to be moved off from and/or onto the first can carrier. Advantageously, at least one displacement device is provided, by means of which the cans are arranged to be moved off from and/or onto the second can carrier. Advantageously, the second can carrier is capable of conveying full cans into and empty cans out of a can store. Preferably, the first can carrier carries a full can (or a can being filled) and an empty can together. Advantageously, when the full can is being moved away from the region of the sliver delivery device, the first can carrier is moved in one of the reciprocating movement directions. Advantageously, for subsequent bringing the empty can in to the region of the sliver delivery device, the first can carrier is moved in a reciprocating movement direction. Advantageously, a sliver separating device is provided. Preferably, the sliver separating device is capable of separating the sliver deposited in the full can from the sliver subsequently supplied from the sliver delivery device. For example, before deposition from the coiler plate, there may be produced, in the sliver, a thin location at which the sliver tears off when the full can is moved away. Preferably, the full can is moved away from the region of the sliver delivery device when the delivery device is located at that end of the full can which is adjacent to the empty can. Preferably, the full can and the empty can are arranged on the first can carrier with their short walls surfaces immediately adjacent to one another. Preferably, the second can carrier is moved in its longitudinal direction. Advantageously, the first can carrier and/or the second can carrier are substantially oblong.

The invention also provides an apparatus at a spinning preparation machine, for example a card, card drawing mechanism, draw frame, combing machine or the like, for changing sliver cans, wherein sliver is delivered by a rotary plate and deposited in a sliver can, comprising means for moving a full sliver can away from the region of the rotary plate and comprising means for subsequently bringing in an empty sliver can from a position of readiness to the region of the rotary plate, wherein a first can path is provided in the region of the rotary plate (coiler plate) and a second can path is provided parallel to the first can path, on each of which can paths a can carrier is movable in two directions, and wherein an empty can is arranged to be moved from a second can path to the first can path and a full can is arranged to be moved from the first can path to a second can path, in which the can carrier on the first can path is capable of collecting and delivering a full can and an empty can, and the can carrier on the second can path is capable of collecting and delivering a full can or an empty can.

The invention further provides a method of filling cans with fibre at a filling station of a textile machine, in which a can being filled is positioned in a filling position, an empty can is delivered to a first reserve position, the filling position and the reserve position being on a common carrier device, the filled can and the empty can are so moved by the carrier device that the empty can is located in the filling position and the filled can in a second reserve position, and the filled can is removed from the second reserve position.

DETAILED DESCRIPTION OF THE PREFERRED EMBODIMENTS

Figure 1:
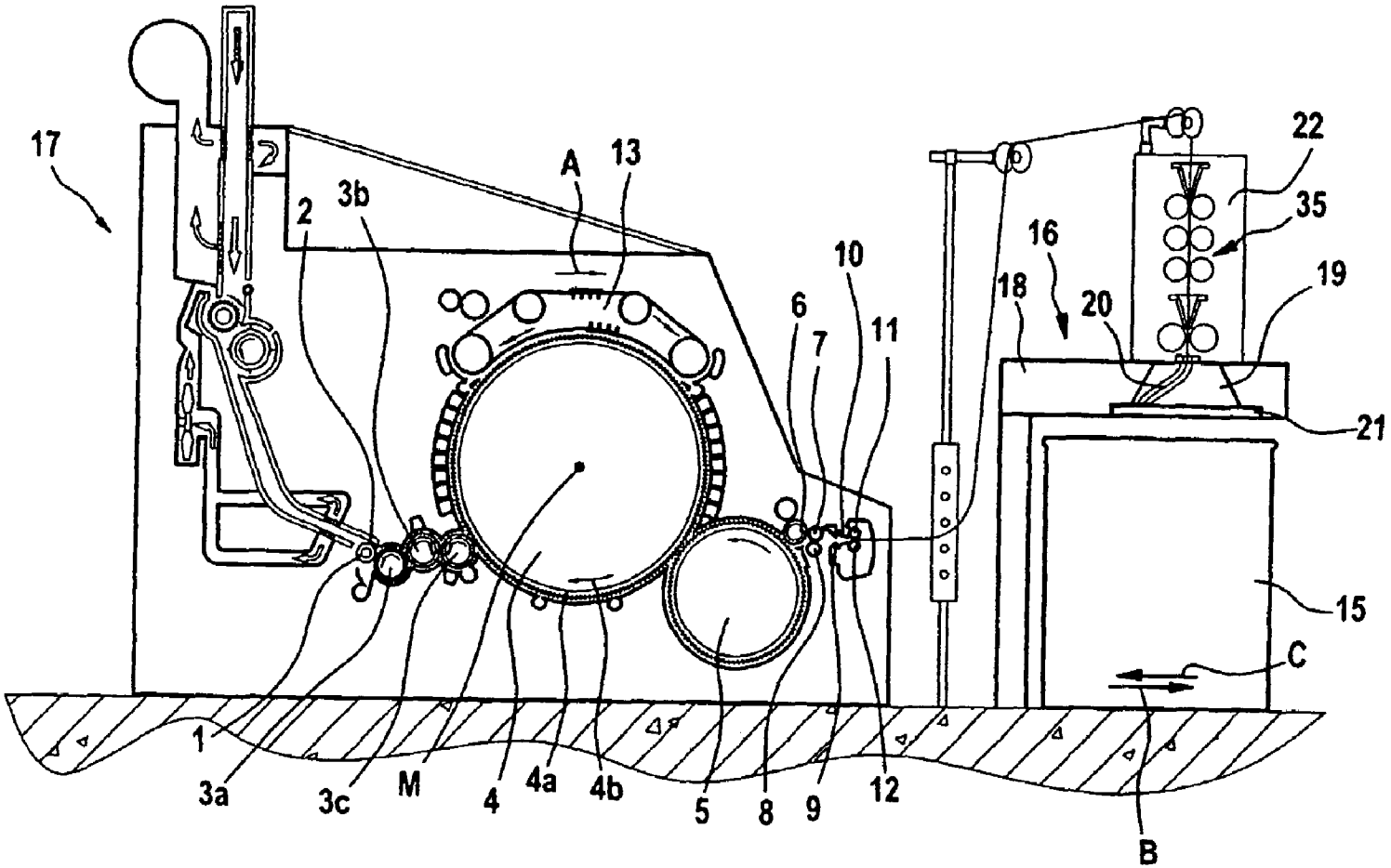
FIG. 1 is a diagrammatic side view of a card having a can coiler and oblong can and also including an apparatus according to the invention.

With reference to FIG. 1, a card, for example a TC 03 card made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers and card top bars, oblong can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. The arrow A denotes the work direction. Upstream of the card is a flock feeding apparatus 17. The coiler plate 19 is rotatably mounted in the coiler plate panel 18. The coiler plate 19 comprises a sliver channel 20, having a sliver inlet and outlet, and a rotary plate 21. Located above the can coiler cover panel 18 is a housing 22, in which the entry to rotating coiler plate 19 and a drawing mechanism 35 upstream thereof are located. The can 15 is in the form of a oblong can and, during filling with sliver by the rotary plate 19, is moved to and fro in the direction of arrows B, C by means of a drive device (not shown). Between the underside of the rotary plate 21 and the top of the oblong can 15, sliver material extending beyond the can coiler is present.

Figure 2:
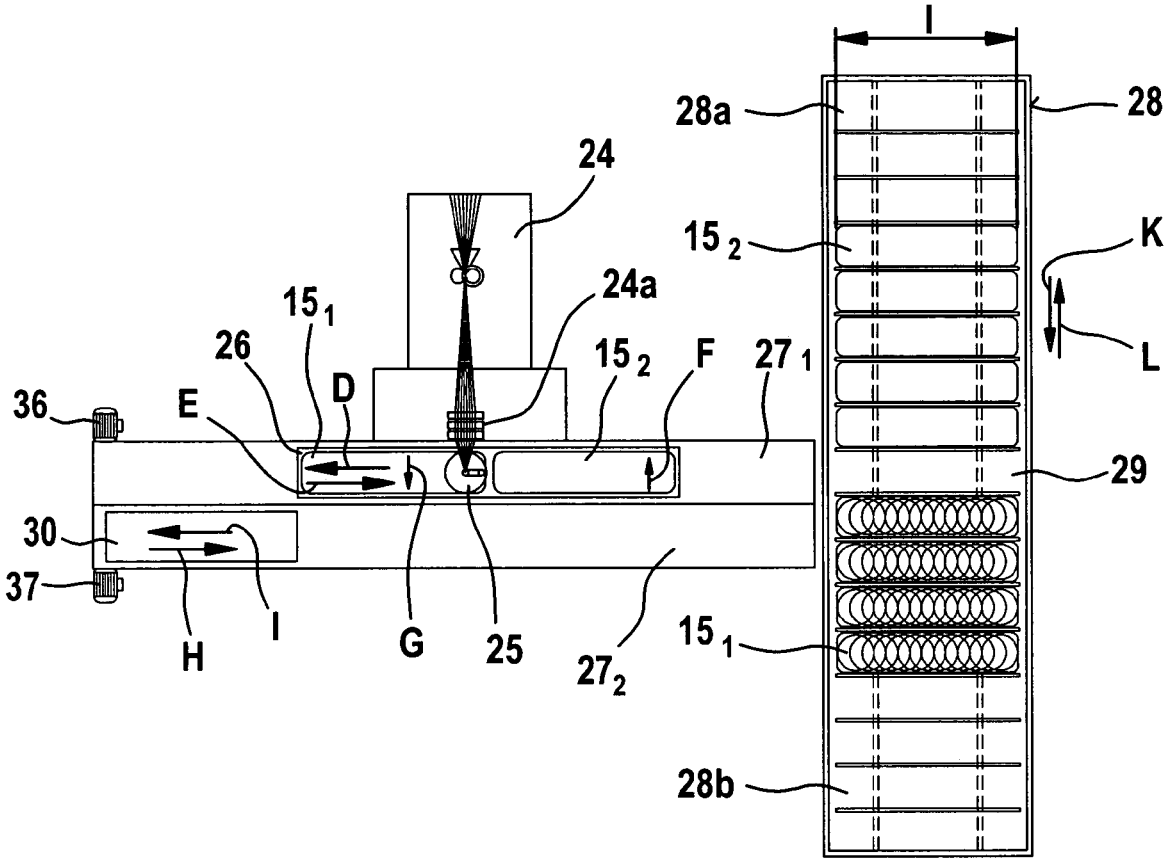
FIG. 2 is a diagrammatic top view of a draw frame for filling oblong cans and also a can store.

FIG. 2 shows a draw frame 24 having a filling station, in which the can to be filed $\mathbf{15}_1$, which has an elongate cross-section, is located in a filling position. The sliver is fed to the can $\mathbf{15}_1$ via the coiler plate 25. For reasons of clarity, the sliver has been shown only in a short partial region. The coiler plate 25 is rotatably mounted in a stationary position in a frame (not shown in further detail). The sliver is fed to the coiler plate 25 in known manner by two calender rollers after it has been delivered to the calender rollers by the draw frame 24. The diameter of the coiler plate 25 corresponds approximately to the width of the narrow side of the can $\mathbf{15}_1$. The can $\mathbf{15}_1$, is located on a carriage 26. In addition, an empty can $\mathbf{15}_2$, is located on the carriage 26. During the filling procedure, a reciprocating movement in the direction of arrows D, E is transmitted, by means of a displacement device, to the carriage 26 having the cans $\mathbf{15}_1$, $\mathbf{15}_2$. As a result, the can $\mathbf{15}_1$ in the filling position moves to and fro, over its entire length, underneath the coiler plate 25, whilst the empty can $\mathbf{15}_2$ in the reserve position on the carriage 26 moves along with it. The reciprocating movement extends over the filling path, which substantially corresponds to the length l of the can. The displacement device is driven by a speed-controlled electric motor. The carriage 26 is moved to and fro on a first path $\mathbf{27}_1$. (The direction of movement of the carriage 26 corresponds to the direction of movement E, D of the cans $\mathbf{15}_1$, $\mathbf{15}_2$.) Arranged parallel to the first path $\mathbf{27}_1$ is a second path $\mathbf{27}_2$, on which there is a carriage 30 for an oblong can. The length of the paths $\mathbf{27}_1$, $\mathbf{27}_2$ corresponds to four times the length l of a can $\mathbf{15}_1$, $\mathbf{15}_2$. Parallel to the longitudinal side of the draw frame 24 there is provided a can store 28, which consists of an empty-can store 28*a* for empty cans $\mathbf{15}_2$ and a full-can store 28*b* for sliver-filled full cans $\mathbf{15}_1$. Seen in the direction of movement (arrows K, L) an intermediate space 29 is provided between the last empty can and the first full can. The empty and full cans $\mathbf{15}_1$, $\mathbf{15}_2$ are located on a conveyor belt, which endlessly revolves around return rollers and which is driven by an electric motor.

Starting from the position and situation shown in FIG. 2, the sliver is delivered in operation by the stationary coiler plate 25 and is deposited in rings, and the can $\mathbf{15}_1$ carries out a movement to and fro (arrows D, E) during the filling procedure. Once the can $\mathbf{15}_1$ has been filled with sliver, the carriage 26 is, for the purpose of can changing, so moved through a can length l in the direction of arrow D that the empty can $\mathbf{15}_2$ is located underneath the coiler plate 25. The carriage 26 then undergoes reciprocating movement in direction D, E so that the can $\mathbf{15}_2$ is filled. At the same time, the carriage 30 moves to and fro in direction D, E parallel to the carriage 26 and to the can $\mathbf{15}_1$. In the process, the can $\mathbf{15}_1$ is moved in the direction of arrow G from the carriage 26 onto the carriage 30 by means of a displacement device (not shown). Then, whilst the can $\mathbf{15}_2$ is being filled, the carriage 30 moves in direction H into the gap 29 and transfers the full can $\mathbf{15}_1$ into the full-can magazine 28*b*. After that, an empty can $\mathbf{15}_2$ is moved from the empty-can magazine 28*a* onto the carriage 30, which is moved in direction I and which, on reaching the carriage 26, then moves parallel to and fro at the same speed as the empty position on the carriage 26 in direction H, I. In the process, the empty can $\mathbf{15}_2$ is moved from the carriage 30 onto the carriage 26 in the direction of arrow F. On-the-fly can changing at maximum speed is accomplished in the manner shown. The continuing supply of sliver from the coiler plate 25 is neither interrupted nor slowed down during can changing. One advantage is the movement of the cans $\mathbf{15}_1$, $\mathbf{15}_2$ between the carriages 26 and 30 (arrows F, G) via the long walls of the oblong cans, that is to say over short distances. A further particular advantage is the arrangement of two cans $\mathbf{15}_1$, $\mathbf{15}_2$ on one carriage 26, which makes possible especially fast can changing between the full can $\mathbf{15}_1$ and the empty can $\mathbf{15}_2$ by means of fast movement of the carriage 26 in the direction of arrow D. The short distance and fast can changing are especially advantageously accomplished when, on can changing, the coiler plate 25 is located at that end of the full can $\mathbf{15}_1$ which is adjacent to the empty can $\mathbf{15}_2$. The full can $\mathbf{15}_1$ and the empty can $\mathbf{15}_2$ are preferably arranged on the carriage 26 with their short wall surfaces immediately adjacent to one another. This also results in fast can changing. In addition, the separated sliver end is prevented from dropping into the intermediate space between the short wall surfaces of the full can $\mathbf{15}_1$ and the empty can $\mathbf{15}_2$; instead, with delivery continuing from the coiler plate 25, the separated sliver end is introduced directly into the empty can $\mathbf{15}_2$. During can changing, the sliver is separated between the coiler plate 25 and full can $\mathbf{15}_1$, for example by means of a thin location—produced in the drawing mechanism 24*a*—at which the sliver tears off on movement of the carriage 26 together with the can $\mathbf{15}_1$ in direction D.

Reference numeral 36 denotes a motor for the drive of the carriage 26 in the direction D, E and reference numeral 37 denotes a motor for the drive of the carriage 30 in the direction H, I.

In order to allow rapid changing of the oblong cans, the oblong can changer is provided with a "filling carriage" 26 for two cans $\mathbf{15}_1$, $\mathbf{15}_2$ and with an incoming and outgoing track $\mathbf{27}_2$ having a separate "changing carriage" 30. The cans $\mathbf{15}_1$, $\mathbf{15}_2$ are located on the filling carriage 26 immediately behind one another in the longitudinal direction. During can changing, the filling carriage 26 and, along with it, the two cans $\mathbf{15}_1$, $\mathbf{15}_2$ are moved rapidly so that within the shortest time the full can $15_1$ leaves the depositing region and the empty can $15_2$ takes up that position. Directly after changing, the filling carriage 26 re-starts the reciprocating movement in the direction D, E and the empty can $15_2$ is filled. At the same time, the changing carriage 30 on the incoming and outgoing track 27 is moved synchronously with the filling carriage 26, alongside the full can $15_1$. The full can $15_1$ can then be pushed slowly (for example, by means of a pneumatic cylinder) from the filling carriage onto the changing carriage and afterwards transported into the can magazine 28. After that, an empty can $15_2$ is taken out of the magazine 28 and brought along the same route to the free position on the filling carriage 26.

Although the foregoing invention has been described in detail by way of illustration and example for purposes of understanding, it will be obvious that changes and modifications may be practised within the scope of the appended claims.

The invention claimed is:

1. A can-changing apparatus for a spinning preparation machine, comprising:

a first can path including a filling position in which a can can receive sliver from a rotary delivery device;

a first can carrier movable along said first can path in a first direction and a second direction;

a second can path;

and a second can carrier movable along said second can path in a first direction and a second direction wherein the second carrier on the second can path is arranged to deliver an empty can to the first can carrier and to collect a full can from the first can carrier.

2. An apparatus according to claim 1, in which the sliver can is an oblong can having a longitudinal dimension and a transverse dimension that is smaller than said longitudinal dimension.

3. An apparatus according to claim 2, in which the first can carrier is arranged to move the oblong can during sliver deposition in a rectilinear reciprocating movement.

4. An apparatus according to claim 3, in which the full can is moved away from and/or the empty can is subsequently brought in to the region of the delivery device in a direction corresponding to the longitudinal dimension of the can.

5. An apparatus according to claim 3, in which the arrangement is such that cans moving from the second can carrier to the first can carrier or from the first can carrier to the second can carrier are moveable in a direction corresponding to the transverse dimension of the can.

6. An apparatus according to claim 3, in which, during transfer of the full can andlor empty can between the can carriers, the can carriers are arranged to be moved at the same speed in the same direction.

7. An apparatus according to claim 3, in which the length of the first can path and the length of the second can path both correspond to at least four times one can length.

8. An apparatus according to claim 3, in which, when the full can is being moved away from the region of the delivery device, the first can carrier is traveling in one of the reciprocating movement directions.

9. An apparatus according to claim 8, in which, for bringing an empty can in to the filling position, the first can carrier is moved in a reciprocating movement direction, the first can carrier thereafter continuing said reciprocating movement about a central point that is displaced along the reciprocating movement direction.

10. An apparatus according to claim 3, in which a sliver separating device is provided, by means of which, before further deposition from the sliver delivery device, there is produced, in the sliver, a thin location at which the sliver tears off when the full can is moved away.

11. An apparatus according to claim 3, in which the first can carrier is arranged to move the full can away from the region of the sliver delivery device when the full can is so located that the sliver is being delivered at that end of the full can which is adjacent to the empty can.

12. An apparatus according to claim 3, in which the full can and the empty can are arranged on the first can carrier with their short wall surfaces immediately adjacent to one another.

13. An apparatus according to claim 3, in which the second can carrier is moved in its longitudinal direction.

14. An apparatus according to claim 1, in which the first can path and the second can path are arranged parallel to one another.

15. An apparatus according to claim 1, in which at least one of said first and second can carriers have a displacement device, by means of which the cans are arranged to be moved off from and/or onto the first can carrier.

16. An apparatus according to claim 1, in which the second can carrier is capable of conveying full cans into and empty cans out of a can store.

17. An apparatus according to claim 1, in which the first can carrier carries a full can and an empty can together.

18. A can-changing apparatus for a spinning preparation machine, comprising: a first longitudinally extending can path; a second longitudinally extending can path parallel to the first path; a can carrier movable in a first direction and a second direction for receiving first and second cans adjacently on the first can path and for retaining a said first or second can during filling thereof from a sliver delivery device; a transfer device for displacing a filled can from said first can path to said second can path; and a transfer device for displacing an empty can from said second can path to said first can path.

19. Apparatus at a textile machine for changing sliver cans, having a rotary plate for depositing fibre sliver in a sliver can, wherein a first can path is provided in the region of the rotary plate and a second can path is provided parallel to the first can path, on each of which can paths a can carrier is movable in two directions, and wherein an empty can is arranged to be moved from a second can path to the first can path and a full can is arranged to be moved from the first can path to a second can path, in which the can carrier on the first can path is capable of collecting and delivering a full can and an empty can, and the can carrier on the second can path is capable of collecting and delivering a full can or an empty can.

* * * * *